US006514007B2

(12) United States Patent
Richter

(10) Patent No.: US 6,514,007 B2
(45) Date of Patent: Feb. 4, 2003

(54) FINISHER TO LAY AND COMPACT ASPHALT LAYERS AND METHOD FOR OPERATING SAME

(76) Inventor: Elk Richter, Alte Dorfstrasse 11, D-38321 Dorstadt (DE)

( * ) Notice: Subject to any disclaimer, the term of this patent is extended or adjusted under 35 U.S.C. 154(b) by 0 days.

(21) Appl. No.: 09/748,401

(22) Filed: Dec. 26, 2000

(65) Prior Publication Data

US 2001/0051073 A1 Dec. 13, 2001

Related U.S. Application Data

(63) Continuation-in-part of application No. 08/656,257, filed as application No. PCT/DE94/01406 on Nov. 23, 1994, now abandoned.

(30) Foreign Application Priority Data

Nov. 27, 1993 (DE) ..... 43 40 422
Dec. 16, 1993 (DE) ..... 43 42 997

(51) Int. Cl.[7] ..... E01C 7/06; E01C 19/12

(52) U.S. Cl. ..... 404/75; 404/101; 404/102; 404/108

(58) Field of Search ..... 404/75, 101, 102, 404/105, 106, 108, 110

(56) References Cited

U.S. PATENT DOCUMENTS

| | | | | | |
|---|---|---|---|---|---|
| 2,134,245 | A | * | 10/1938 | Carswell | 404/102 |
| 2,197,878 | A | * | 4/1940 | Robinson | 118/118 |
| 2,255,345 | A | * | 9/1941 | Bailey | 105/239 |
| 2,255,346 | A | * | 9/1941 | Bailey | 222/196 |
| 2,396,426 | A | * | 3/1946 | Jackson | 122/235.31 |
| 3,343,470 | A | * | 9/1967 | Atkinson | 404/108 |
| 3,519,169 | A | * | 7/1970 | Holland | 222/136 |
| 4,066,723 | A | | 1/1978 | King et al. | |
| 4,131,670 | A | * | 12/1978 | Abate | 264/256 |
| 4,473,320 | A | * | 9/1984 | Register | 404/101 |
| 4,534,674 | A | | 8/1985 | Cutler | |
| 4,594,022 | A | | 6/1986 | Jeppson | |
| 4,636,110 | A | * | 1/1987 | Augoyard | 404/100 |
| 4,818,139 | A | | 4/1989 | Brock et al. | |
| 5,009,544 | A | * | 4/1991 | Chaize | 172/4.5 |
| 5,035,534 | A | | 7/1991 | Brock et al. | |
| 5,069,578 | A | | 12/1991 | Bense et al. | |
| 5,100,277 | A | | 3/1992 | Musil | |
| 5,348,418 | A | | 9/1994 | Campbell | |
| 5,615,973 | A | | 4/1997 | Campbell | |
| 5,879,104 | A | * | 3/1999 | Ulrich | 404/102 |
| 6,033,147 | A | | 3/2000 | Richter | |

FOREIGN PATENT DOCUMENTS

| | | | |
|---|---|---|---|
| DE | 3 731 716 | | 4/1988 |
| DE | 9 013 760 | | 4/1991 |
| EP | 381 882 | | 8/1990 |
| EP | 281 882 | | 9/1998 |
| FR | 2 536 772 | | 6/1984 |
| FR | 2 697 036 | | 4/1994 |
| JP | 9-505370 | * | 5/1997 |
| JP | 10-183513 | * | 7/1998 |
| WO | 95/14820 | * | 6/1995 |
| WO | 99/27189 | * | 3/1999 |

* cited by examiner

*Primary Examiner*—Gary S. Hartmann
(74) *Attorney, Agent, or Firm*—Collard & Roe, P.C.

(57) ABSTRACT

This invention relates to a finishing device to lay and compact asphalt layers and a method for operating the device. The finisher according to the invention is provided with a receiving device for the temporary storage of the hot mixture. The receiving device consists of two separate receiving buckets, from each of which a mixture transport system with at least one conveyance device leads to the distribution devices, and the distribution devices are constructed as spreader screws.

14 Claims, 11 Drawing Sheets

FINISHER TO LAY AND COMPACT ASPHALT LAYERS AND METHOD FOR OPERATING SAME

This application is a continuation-in-part of U.S. patent application Ser. No. 08/656,257, filed on Jul. 22, 1996 now abandoned which is a 371 of PCT/DE94/01406 filed on Nov. 23, 1994.

BACKGROUND OF THE INVENTION

1. Field of the Invention

The invention relates to a finishing device to lay and compact asphalt layers and a method for operating the device.

2. The Prior Art

Asphalt finishers are known that consist of a receiving bucket, for the temporary storage of the hot asphaltic mixture, and conveyor belts, for the longitudinal transport of the asphalt before the laying beam. Spreader screws are provided for demixing-free transverse distribution of the mixture across the laying width and a laying beam for pre-compaction and striking off the asphalt. The laying beam is suspended on a traction vehicle in an articulated manner and floats upon the mixture to be laid.

Conventional laying beams consist of a tamping beam (tamper) and vibrating beam (screed plate).

The newer high compaction beams contain additional compacting elements in order to increase the level of pre-compaction. Depending on the effectiveness of the laying beams, rollers may be used for recompacting.

Thus, a layer is laid of the mixture in the receiving bucket in the specified thickness. The amount of compaction is a deciding factor in the mechanical properties and the durability of the asphalt. Higher compaction means a significant improvement in quality with the correct mixture conception and a suitable course structure. The continuous growth in traffic and the increase in axle loads requires a high degree of compaction.

According to German Patent No. 90 13 760.4 U1, a road building machine for renewing road surfacing is disclosed, which consists of heating aggregates of a milling unit provided with a drive unit, a mixing unit and a conveyance device, and drawing off new material from a material trough, as well as a laying unit. The conveyance device consists of two belt-conveyors arranged in tandem in the lengthways direction of the road building machine. The first conveyor belt extends from the material trough to a transfer unit disposed between the tractive machine and the trailer and the second conveyor belt extends from the transfer unit into the region of the laying units.

In the case of these finishers, the existing asphalt is heated by heating aggregates which are then reamed, distributed or fed into a mixing region and then distributed. Because the bitumen is a relatively poor heat conductor, temperatures of 300° to 600° C. or more are required to heat the approximately 4 cm thick top region. The use of these finishers working in combination with heating aggregates thus leads to significant environmentally degrading emissions, owing to large temperature differences within the asphalt. Thereby the binder is modified and the job site mixture is subject to a series of factors, which lead to considerable fluctuations in quality within a section under construction compared with production at an asphalt mix plant. In the case of these finishers, it is also disadvantageous that a certain dwell time is required to heat the lower courses, which is also dependent on the weather to a great extent. Consequently, only a low working speed is possible and the course thickness of the asphalt to be distributed or changed is limited.

The disadvantage of the known finishers is that they only enable the laying of a delivered type of asphalt mixture. Surface and binder courses are laid in relatively thin coats. Asphalt compacting depends largely upon the thermal capacity of the asphalt layer. This is closely related to the layer thickness, the weather conditions, and the temperature of the mixture as delivered on the job site.

Rapid asphalt temperature losses lead to difficulties during compacting, to insufficient bonding between layers and increased voids content diminish the quality. In numerous studies, it has been proven that there are manifold deficiencies in the compacting of relatively thin rolled asphalt surface layers. Necessitated by the sequence of construction operations, allocation of funds, and unpredictable weather influences, asphalt surfaces are often laid during unfavorable weather conditions. Raising the mixture temperature in the delivery state is subject to limits as it causes increasing oxidation of the binder, which in turn worsens the compaction ability and is generally disadvantageous. Generally, one thus strives to lower mixture temperatures rather than increasing them.

SUMMARY OF THE INVENTION

It is the object of the present invention to provide a finisher which enables high compaction of the asphalt without increasing the processing temperature and without increasing compaction expenditures.

This object is accomplished by providing a method in which the material is transported simultaneously from two separate receiving buckets attached to the machine, via two independent conveyance systems, to respective distribution devices. The distribution devices are arranged in tandem, staggered in the direction of operation, the devices deposit the material in superimposed layers and lay it.

The finisher according to the invention is provided with a receiving device for the temporary storage of the hot mixture. The receiving device consists of two separate receiving buckets, from each of which a mixture transport system with at least one conveyance device leads to the distribution devices, and the distribution devices are constructed as spreader screws.

The finisher according to the invention is advantageous over the prior art in the following ways. In practice, it has been demonstrated that when laying thicker courses, better degrees of compactness are achieved with the same technology. The finisher according to the present invention allows the simultaneous laying of two different hot mixtures directly upon each other. With the increase in layer thickness, the thermal capacity of the laid asphalt is considerably increased so that laying may even be carried out during unfavorable weather conditions.

Moreover, the finisher according to the invention enables the simultaneous laying of two supplied asphalts, different in composition, in hot work method, which are produced in an asphalt mixing plant under strictly controlled qualitative and environmentally relevant conditions.

Furthermore, it is advantageous that, through direct hot-on-hot laying, an optimum bonding between the two layers is achieved. The otherwise conventional use of asphaltic emulsions to bind the asphalts is not required. The considerably greater thermal potential also effects a better bonding with the already laid asphalt courses.

In contrast to the recycling finishers, the finisher according to the present invention enables a high working speed.

The asphalt delivered from the mixing plant has fewer fluctuations and a defined temperature. Furthermore, the aforementioned hazardous emissions are avoided, as production is effected at an even and low temperature.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
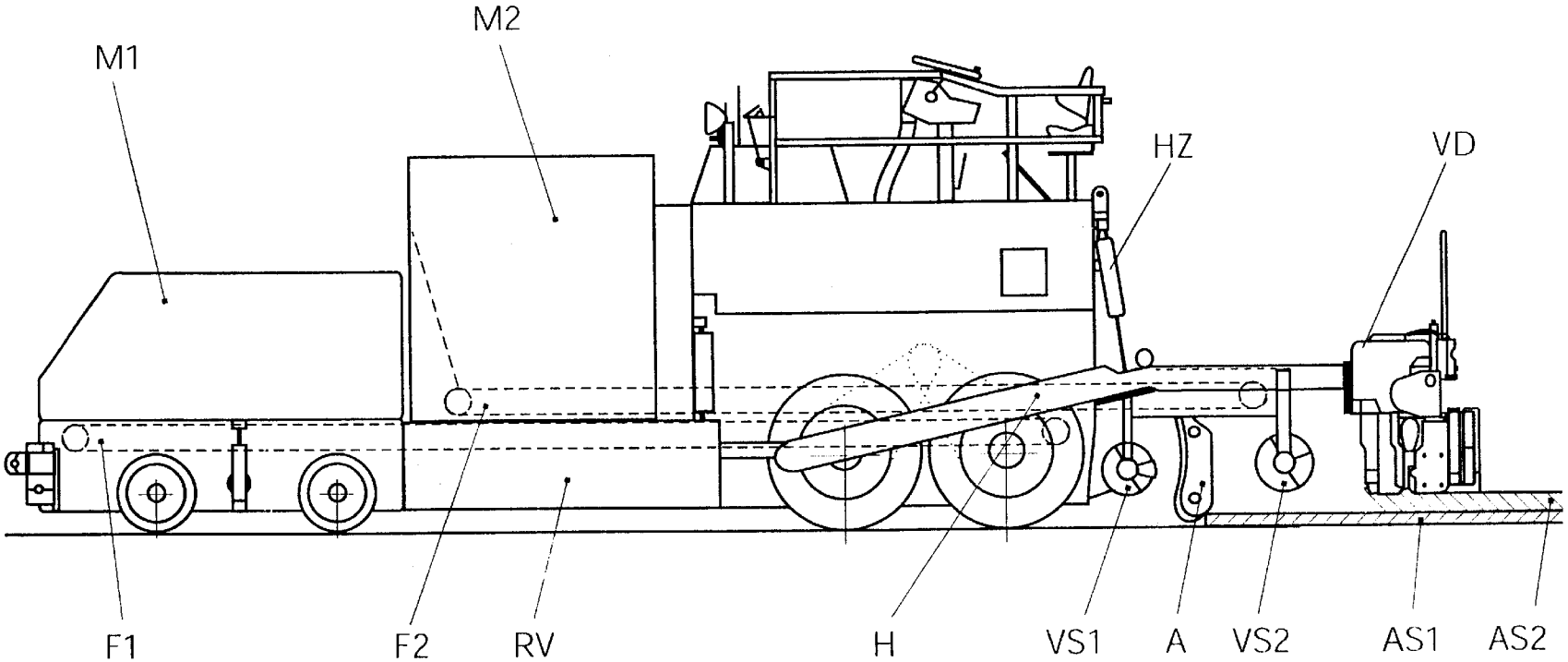
FIG. 1 shows a side view of the finishers for the simultaneous installation of two asphalt layers with different compositions over the entire installation width.

Referring now in detail to the drawings, FIG. 1 shows an embodiment of the asphalt finisher according to the invention with two mixture buckets M1 and M2, which are manufactured by modifying known construction systems for asphalt finishers. The finisher is extended by a frame extension RV of 1400 mm. A conveyor belt F1 is provided for the lower asphalt layer. In addition, the basic unit is raised by 450 mm and an additional conveyor F2 is installed for the top asphalt layer. The asphaltic material is distributed with the aid of two spreader screws VS1, VS2. A screed plate A or stripper is attached to the finisher for correct production of the thickness of the first asphalt course AS1. A second asphalt course AS2 is also provided. After the first mixture type, the second mixture type is laid immediately and both layers are compacted together. A hydraulic pulling system HZ is provided for changing the weight of strut H. A tamping beam VD precompacts the two asphalt layers.

Figure 2:
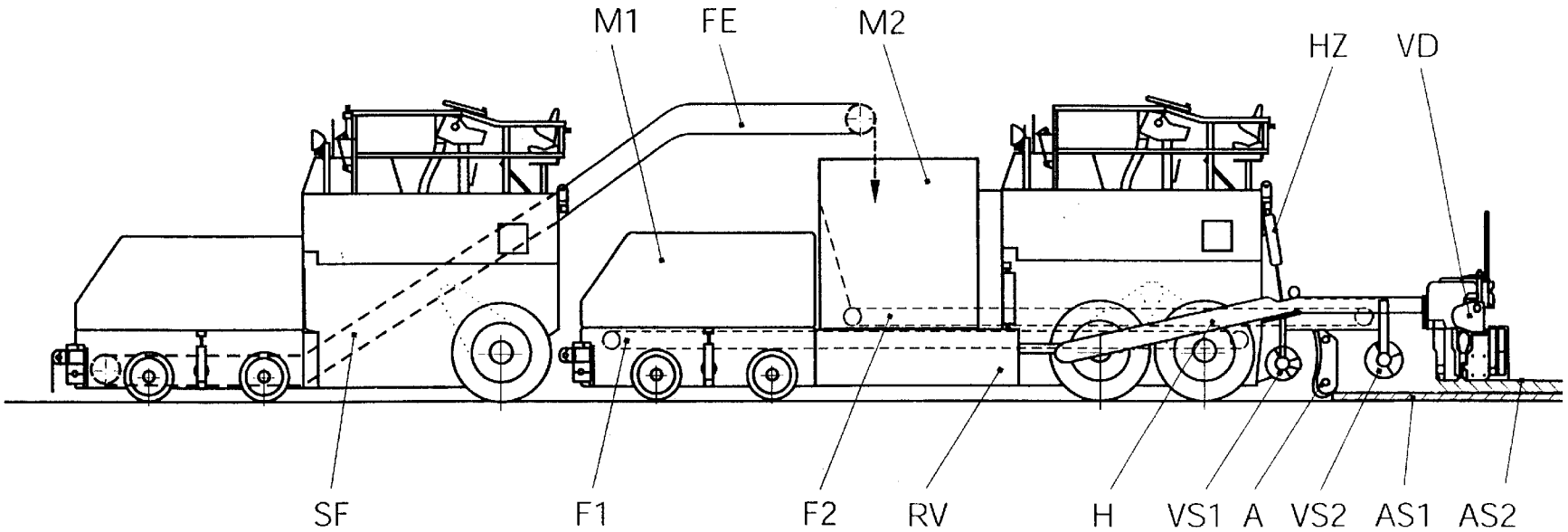
FIG. 2 shows a side view of the finisher for the simultaneous installation of two asphalt layers with different compositions over the entire installation width with a self-driving conveyor device for charging a bucket.

FIG. 2 shows a self-driving vehicle having a conveyor belt FE. In this case, conveyance device FE is a transport belt to charge the second mixture bucket. This system alternately loads receiving buckets M1 and M2.

Figure 3:
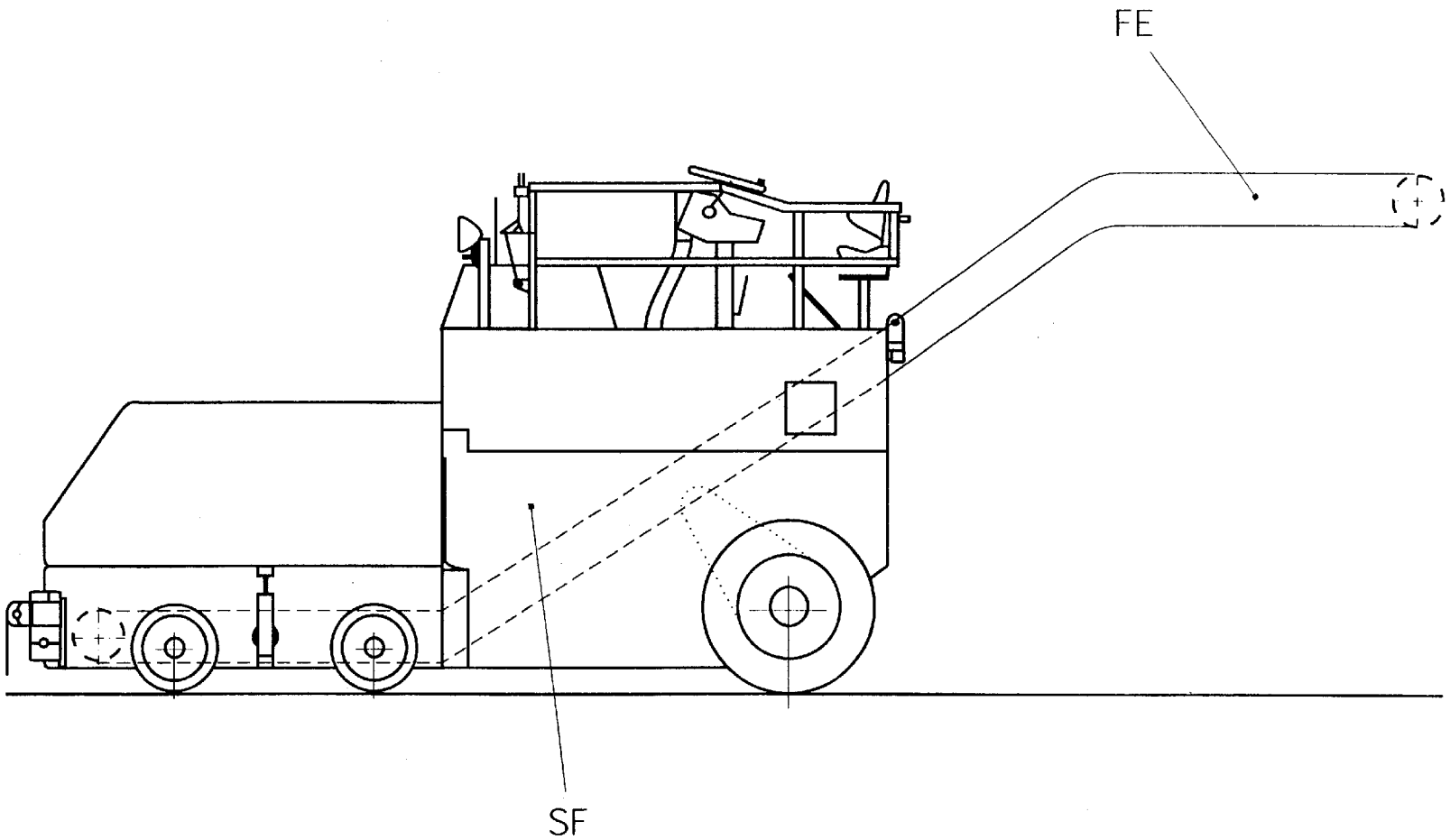
FIG. 3 shows a side view of a self-driving vehicle with a transporting belt for alternately loading the buckets with asphalt from the stationary asphalt plant.

FIG. 3 shows the self-driving vehicle SF with conveyance device FE. An in line arrangement of a conveyor, an intermediate storage capacity is created, which guarantees that the finisher troughs can be charged continuously and ensure an even sequence of finisher operations.

Figure 4:
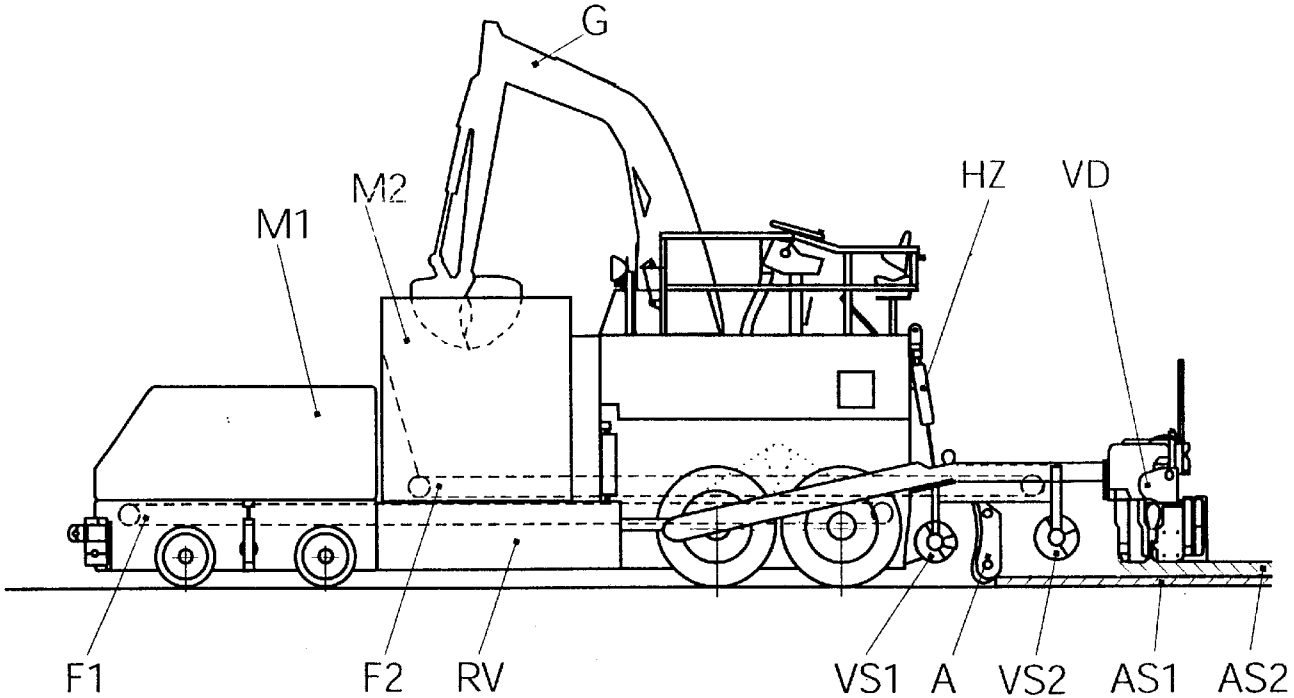
FIG. 4 shows a side view of the finisher for the simultaneous installation of two asphalt layers with different compositions across the entire installation width, with a bucket crane for charging the buckets.

FIG. 4 shows the finisher of FIG. 1 having a grab G. Grab G can be a crane and is used to load bucket M2.

Figure 5:
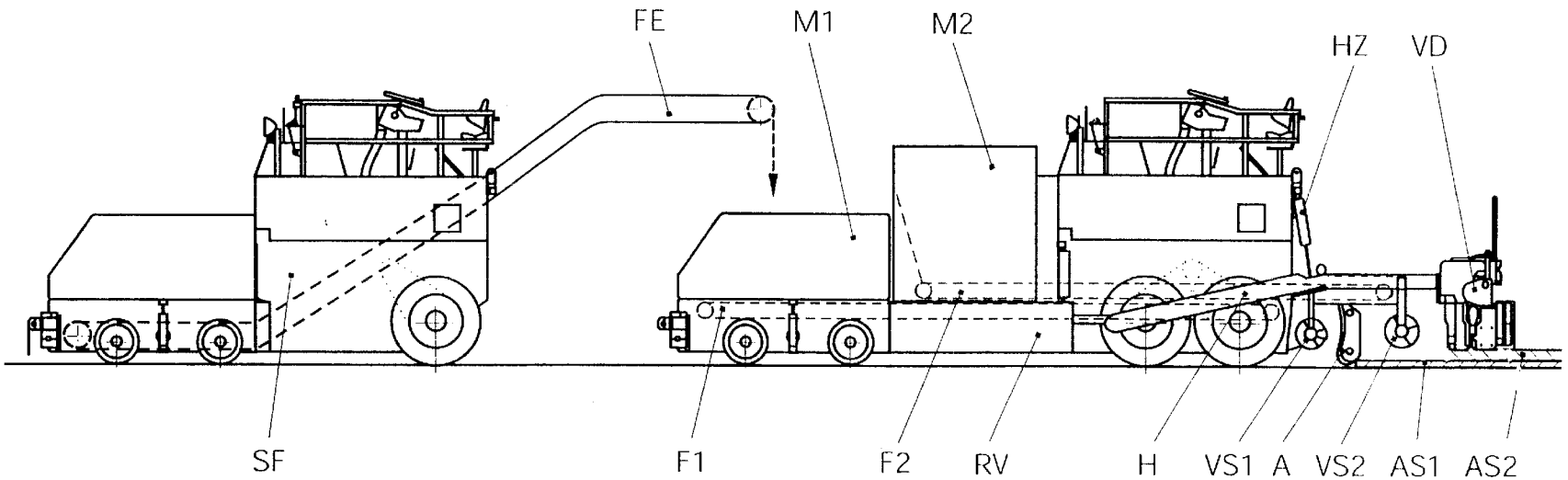
FIG. 5 shows a side view of the finisher for the simultaneous installation of two asphalt layers with different compositions across the entire installation width, with a self-driving conveyor system for loading a bucket.

FIG. 5 shows the finisher having a self-driving conveyor system SF for loading M1.

Figure 6:
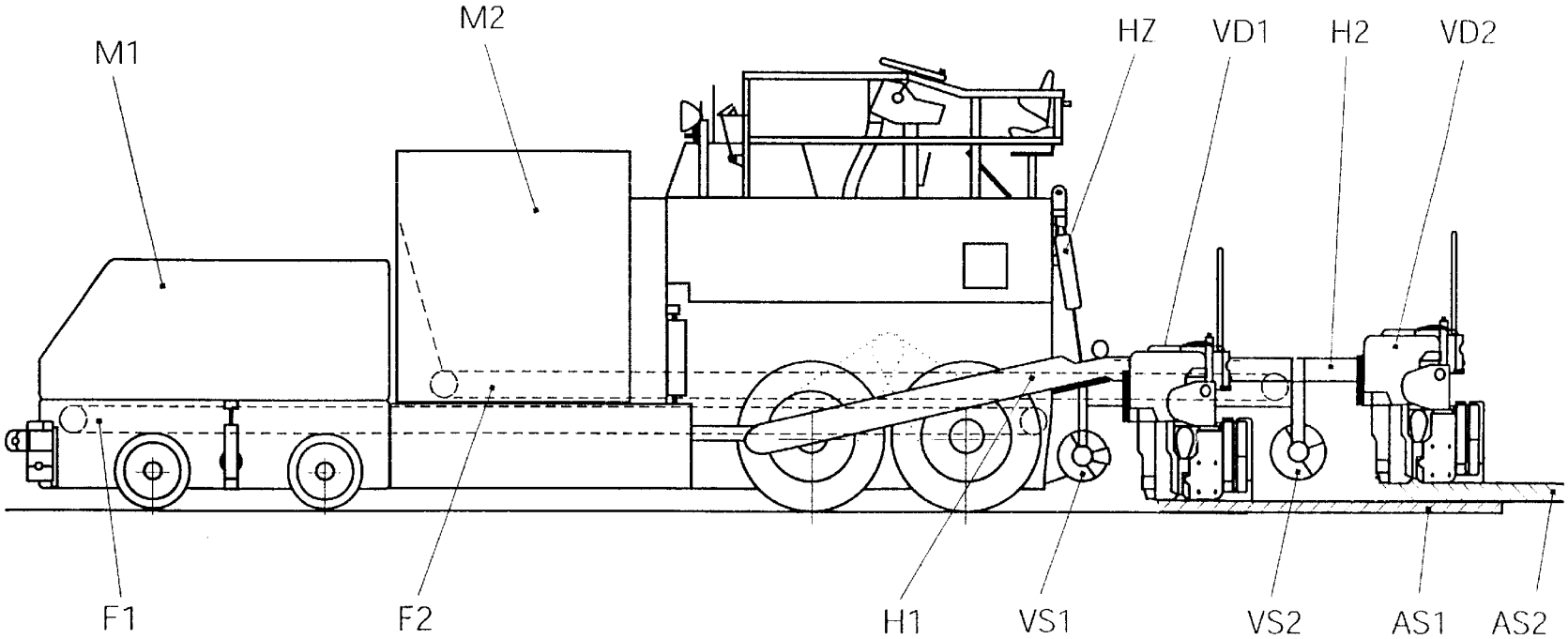
FIG. 6 shows a side view of the finisher for the simultaneous installation of two asphalt layers with different compositions over the entire installation width, with two tamping beams.

FIG. 6 shows the finisher having two tamping beams VD1 and VD2. Tamping beam VD1 is suspended from strut H1 and tamping beam VD2 is suspended from strut H2.

Figure 7:
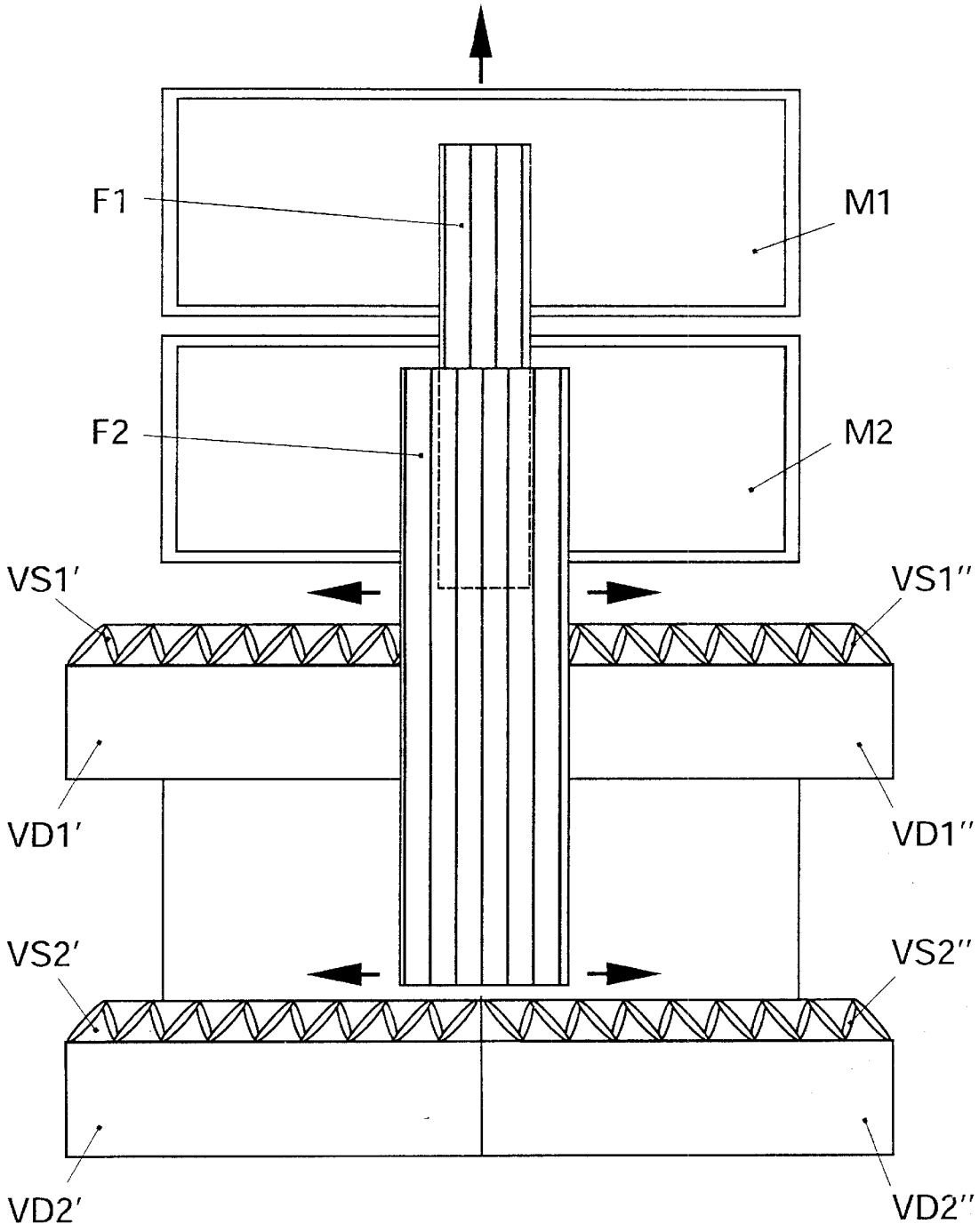
FIG. 7 shows a top view of the finisher for the simultaneous installation of two asphalt layers with different compositions, with tamping beams.

FIG. 7 shows a top plan view onto the finisher for placing of two asphalt layers. Two mixing-material containers M1 and M2 are attached at the front side. The mixed material from the container Ml is transported to the two oppositely operating distribution worms VS1' and VS1". The cover-layer mixed material is transported from the container M2 and the cover-layer mixed material is brought from there to distribution worms VS2' and VS2".

Figure 8:
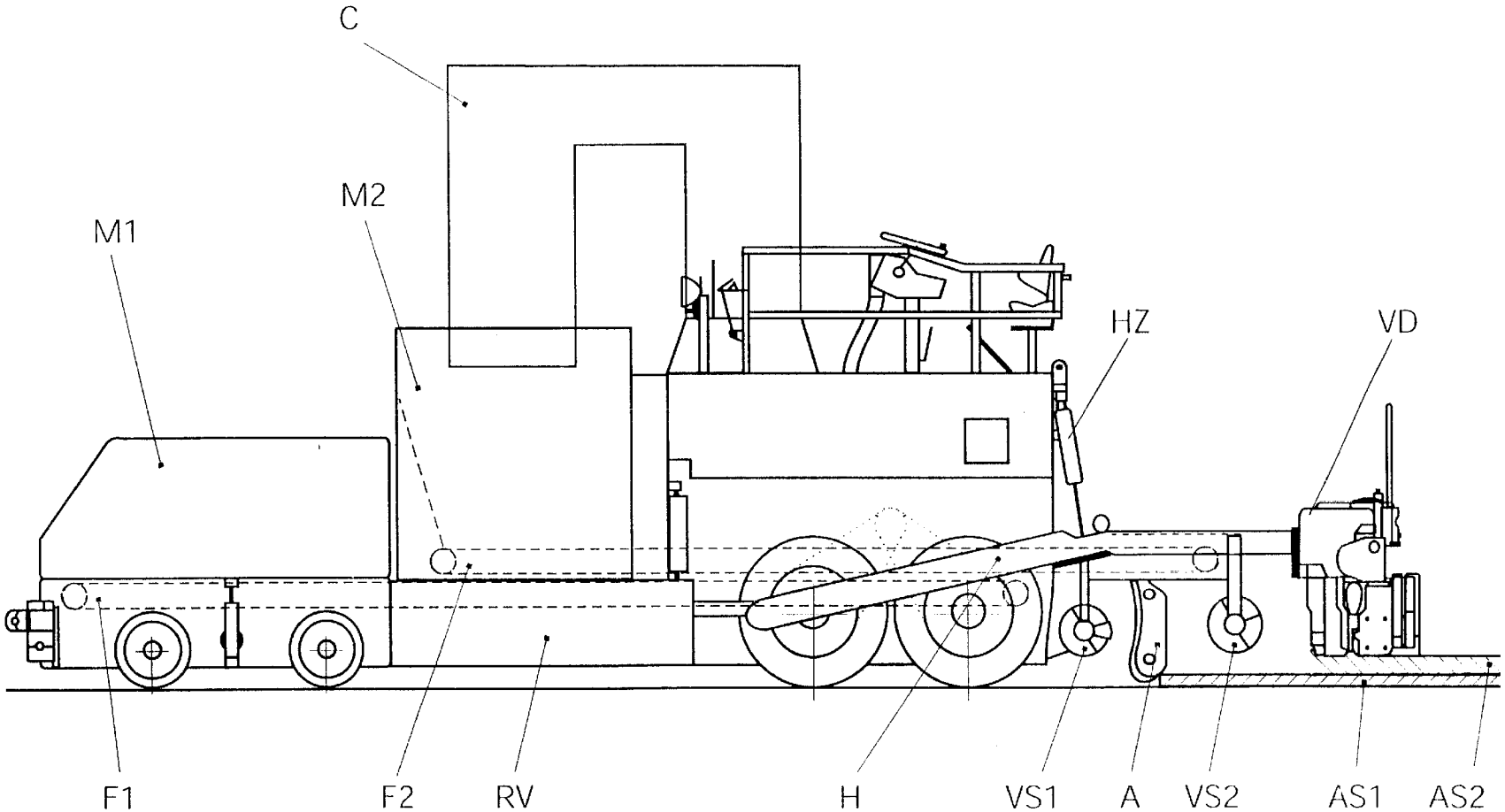
FIG. 8 shows a side view of the finisher for the simultaneous installation of two asphalt layers with different compositions over the entire installation width, with asphalt in the container for loading a bucket.

FIG. 8 shows the finisher of FIG. 1 incorporating a container C for loading M2.

Figure 9:
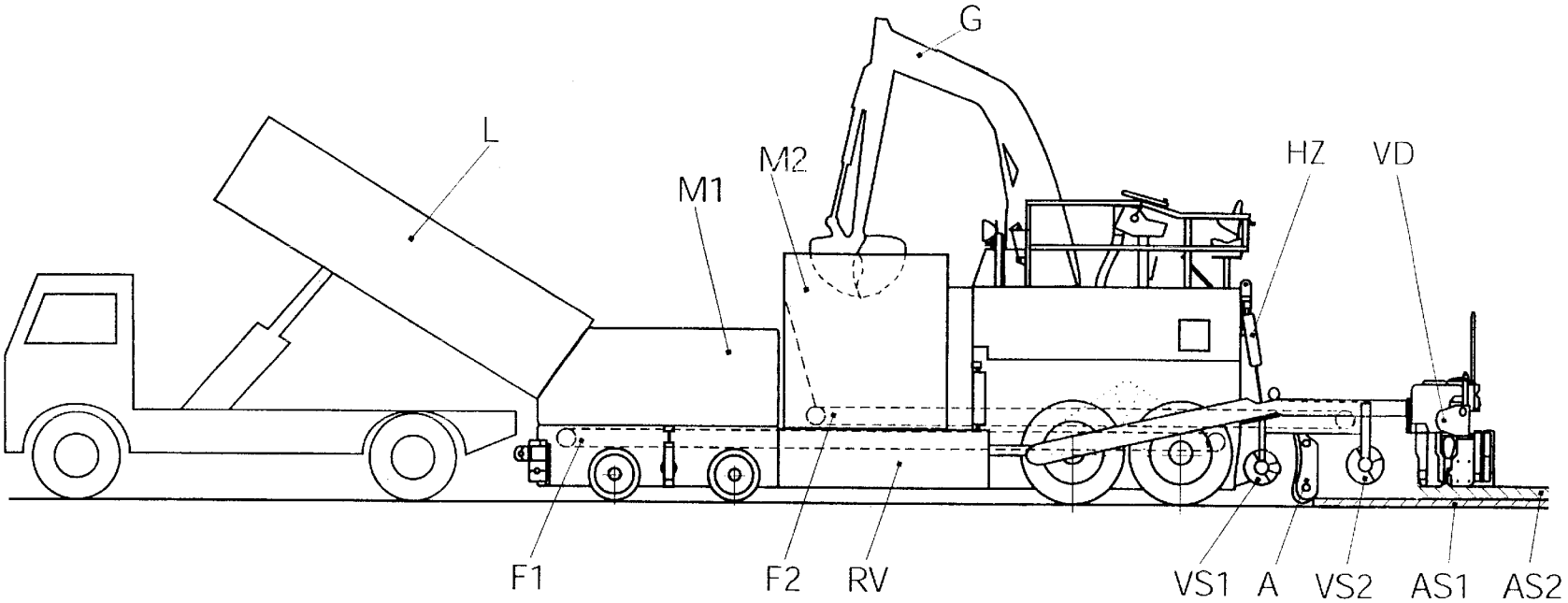
FIG. 9 shows a side view of the finisher for the simultaneous installation of two asphalt layers with different compositions over the entire installation width, with loading of M1 from a truck and loading of a bucket with a bucket crane.

FIG. 9 shows bucket M1 of the finisher being loaded from a truck L. Loading of bucket M2 is accomplished by bucket crane G.

Figure 10:
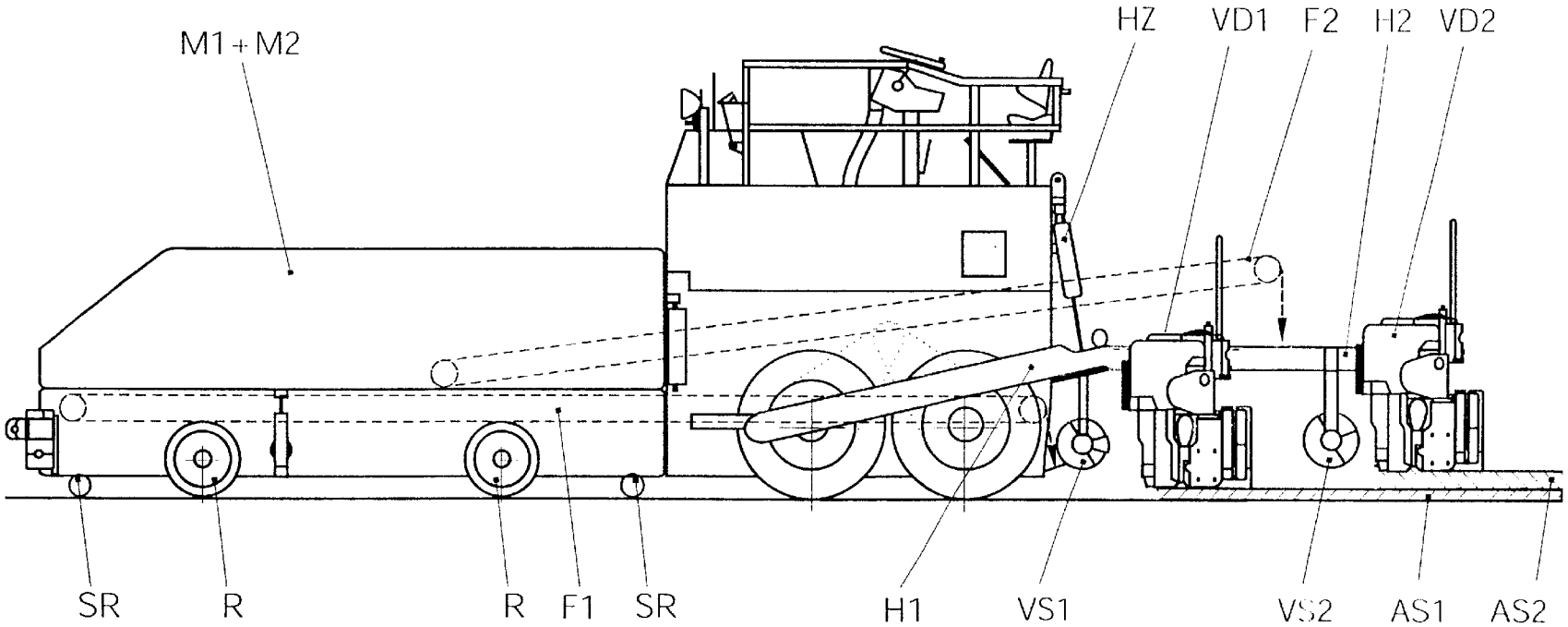
FIG. 10 shows a side view of the finisher for the simultaneous installation of two asphalt layers with different compositions over the entire installation width, with receiving buckets disposed next to each other and with direct loading from a truck.
Figure 11:
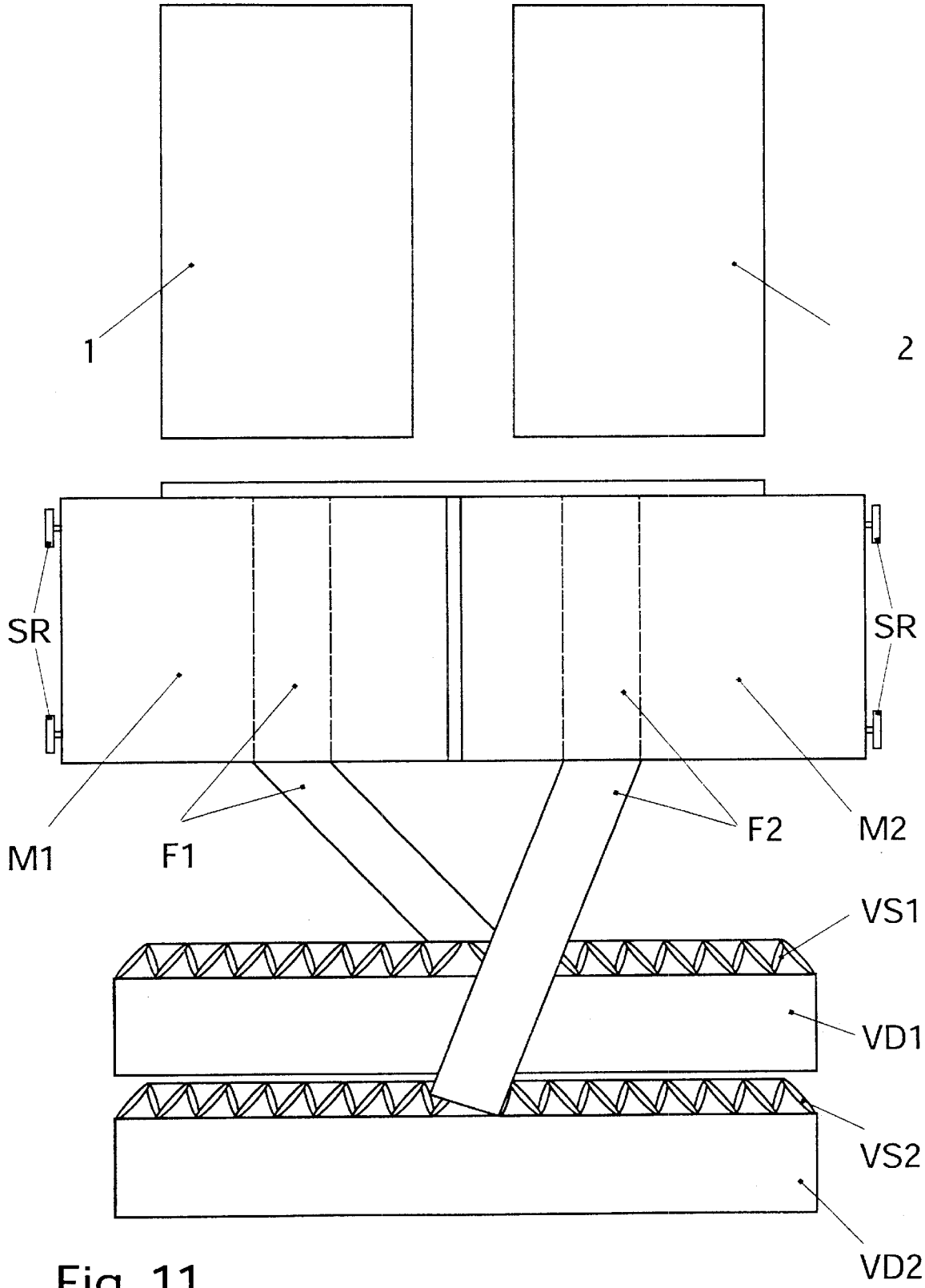
FIG. 11 shows a top view of the finisher for the simultaneous installation of two asphalt layers with different compositions over the entire installation width, with receiving buckets disposed next to each other and with direct loading from a truck.

FIGS. 10 and 11 show receiving containers M1 and M2 which are created by separating and enlarging the receiving container of a conventional finisher and are additionally stabilized laterally by the support wheels SR. The receiving containers M1 and M2 are directly loaded by means of trucks supplying the asphalt from the stationary mixing plant. The asphalt for the lower layer AS1 is supplied by a truck 1, and the asphalt for the top layer AS2 with a second truck 2, and the receiving buckets M1 and M2 are directly loaded. The asphalt for the lower layer AS1 is transported via the conveyor system F1, which extends outside of receiving container M1 offset sideways to the center of the distributor device VS1. The asphalt is distributed sideways and profiled and precompacted by tamping beam VD1. The asphalt for the top layer AS2 is transported via the conveyor system, which extends outside of the receiving container M2 in an ascending manner and is offset sideways to the center of the distributor device VS2 and onto the hot lower asphalt layer. The asphalt is distributed sideways, profiled, and precompacted by tamping beam VD2. Final compacting of both layers is accomplished by rolls (not shown).

Direct loading from trucks into the receiving buckets M1 and M2 may cause knocking against the finisher and lead to uneven spots in the asphalt layer pavement. Therefore, it is possible to feed two receiving buckets M1 and M2 with a self-driving vehicle SF equipped with the conveyor belt FE. A drive wheel or chassis R is provided on receiving buckets M1 and M2. In addition, support wheels SR are disposed on receiving buckets M1 and M2. The asphalt so supplied is transported in this connection alternately into the self-driving vehicle from truck 1 or truck 2, and the receiving containers M1 and M2 are subsequently loaded via the conveyor belt FE.

Accordingly, while only a few embodiments of the present invention have been shown and described, it is obvious that many changes and modifications may be made thereunto without departing from the spirit and scope of the invention.

What is claimed is:

1. A bitumen-laying machine for applying and compacting webs of bitumen comprising:

an undercarriage having a frame extension;

a first receiving container for intermediately storing a first hot mixture, wherein said first receiving container is secured on said frame extension;

a first distributor device disposed behind said first receiving container in a driving direction, comprising two distributor screws operating in opposed directions for distributing without segregating said first hot mixture transversely across an application width, in the form of a first bitumen layer;

a first conveyor system disposed between said first receiving container and said first distributor device for transporting said first hot mixture from said first receiving container to said first distributor device, and for applying said first hot mixture without compacting said first layer;

a second receiving container secured on said frame extension for intermediately storing a second hot mixture;

a second distributor device disposed behind said first distributor device in said driving direction, comprising two distributor screws for distributing without segregating said second hot mixture on said first hot mixture in the form of a second bitumen layer transversely across the same width as said first bitumen layer, wherein said first distributor device and said second distributor device are arranged in tandem to apply said second bitumen layer immediately after said first bitumen layer while said first bitumen layer is still hot;

a second conveyor system disposed between said second receiving container and said second distributor device, for transporting said second hot mixture from said second receiving container to said second distributor device;

a tamping beam mounted behind said second distributor device for stripping and pre-compacting said second bitumen layer;

a sheet metal stripper mounted behind said first distributor device for leveling said first bitumen layer; and a second compacting device arranged behind said first distributor device for pre-compacting said first bitumen layer.

2. The bitumen applicator machine according to claim 1, further comprising a telescopic stripper secured on said frame extension.

3. The bitumen applicator machine according to claim 1, further comprising a self-driving trough with a conveyor belt for feeding said second receiving container.

4. The bitumen applicator machine according to claim 1, wherein said first receiving container and said second receiving container are formed by separating and expanding a receiving container.

5. The bitumen applicator machine according to claim 1, wherein said second receiving container is sized to receive 13 tons of said second hot mixture.

6. The bitumen applicator machine according to claim 1, wherein said first receiving container and said second receiving container are disposed next to each other and have laterally arranged support wheels and said conveyor systems each consist of two part systems arranged at an angle to permit the transport from said receiving containers arranged next to each other, to the center of each of said distributor systems.

7. The bitumen applicator machine according to claim 1, wherein feeding said first receiving container and said second receiving container is accomplished by a trough with its own drive with a conveyor belt or a bucket crane.

8. The bitumen applicator machine according to claim 1, wherein said first and second conveyor systems are equipped with a conveyor belt.

9. The bitumen applicator machine according to claim 1, wherein said first receiving container is directly fed from a truck, and said second receiving container is fed by a bucket crane.

10. A method for operating an application machine for applying and compacting layers of bitumen, comprising the following steps:

supplying a first receiving container for intermediately storing a first hot mixture;

supplying a second receiving container for intermediately storing a second hot mixture;

simultaneously transporting said first hot mixture from said first receiving container via a first conveyor system to a first distributor device and said second hot mixture from said second receiving container via a second conveyor system to a second distributor device, wherein said first and said second distributor devices are arranged one after the other in tandem and in a working direction;

distributing without segregating said first hot mixture transversely across a width of the lane via said first distributor device;

applying said first hot mixture in the form of a first bitumen web over said width of the lane starting from a center of the lane and extending outward to the right and left;

producing a correct level of said first web of bitumen by a stripper;

distributing without segregating said second hot mixture transversely across said width of the lane via said second distributor device;

applying said second hot mixture in the form of a second bitumen web over said width of the lane starting from said center of the lane and extending outward to the right and left simultaneously while said first hot mixture is applied by said first distributor device, wherein said second bitumen layer is laid over said width of said first bitumen web, wherein said first bitumen web and said second bitumen web are disposed one on top of the other, and wherein said second hot mixture is different from said first hot mixture, and both hot mixtures have been produced in a stationary mixing plant;

stripping and pre-compacting said second bitumen layer; and joint compacting said first and second bitumen layers.

11. A machine for applying and compacting layers of bitumen comprising:

a chassis having a frame extension;

a first receiving container secured on said frame extension for an intermediate storage of a first hot mixture;

a first conveyor device disposed behind said first receiving container in a driving direction, for transporting said first hot mixture;

a first distributor device disposed behind said first conveyor device in said driving direction, for transversely distributing without segregating said first hot mixture across an application width, wherein said first distributor device has two distributor screws operating in opposite directions;

a tamping beam mounted behind said first distributor device in said driving direction;

a second receiving container for the intermediate storage of a second hot mixture;

a second conveyor device for transporting said second hot mixture disposed in front of said tamping beam and for applying said second mixture across said application width while said first hot mixture is being applied; and a second distributor device for transversely distributing without segregating said second hot mixture across said application width, wherein said second distributor device has two distributor screws, and wherein said second distributor device jointly compacts said first and second layers.

12. The bitumen applicator machine according to claim 11, wherein said second receiving container is formed by separating and enlarging said first receiving container.

13. The bitumen applicator machine according to claim 11, further comprising a trough with its own drive with a conveyor belt or a bucket crane for feeding said first receiving container and said second receiving container.

14. The bitumen applicator machine according to claim 11, further comprising a transporting device secured on said frame extension, wherein said first receiving container is fed via said transporting device and said second receiving container is fed via said transporting device.

* * * * *